US005689776A

United States Patent [19]

Radcliffe et al.

[11] Patent Number: 5,689,776

[45] Date of Patent: Nov. 18, 1997

[54] CONTACT CHARGING SYSTEM FOR UNIFORMLY CHARGING A CHARGE RETENTIVE SURFACE

[75] Inventors: Andrew B. Radcliffe, Rochester; Dale R. Mashtare, Macedon, both of N.Y.

[73] Assignee: Xerox Corporation, Stamford, Conn.

[21] Appl. No.: 538,927

[22] Filed: Oct. 4, 1995

[51] Int. Cl.[6] ..... G03G 15/02

[52] U.S. Cl. ..... 399/174; 361/225

[58] Field of Search ..... 355/219; 261/220, 261/221, 225; 399/174

[56] References Cited

U.S. PATENT DOCUMENTS

| | | | |
|---|---|---|---|
| 2,912,586 | 11/1959 | Gundlach | 250/49.5 |
| 3,398,336 | 8/1968 | Martel et al. | 317/262 |
| 4,380,384 | 4/1983 | Ueno et al. | 355/219 |
| 4,922,299 | 5/1990 | Uchimoto et al. | 355/219 |
| 5,126,913 | 6/1992 | Araya et al. | 361/225 |

*Primary Examiner*—William J. Royer
*Attorney, Agent, or Firm*—William A. Henry, II

[57] ABSTRACT

A contact charging system uniformly charges a photoconductive surface by the use of a resistive belt surrounding and moved by two rollers and in contact with the photoconductive surface. The roller at the pre-nip area is grounded while that at the post-nip area is kept at a desired high potential. Alternatively, a pair of shoes are used for contact charging a photoconductive surface with one of the shoes being grounded and the other being biased to a desired DC potential by a biasing source. A resistive film is in contact with the pair of shoes with both the film and shoes being in contact with the photoconductive surface. Also, a blade is used to uniformly charge a photoconductive surface with one portion of the blade being grounded and another portion being biased to a desired DC potential. The blade is in direct contact with the photoconductive surface. This charging system tailors the electric field so that air breakdown only occurs at the post-nip area.

6 Claims, 2 Drawing Sheets

CONTACT CHARGING SYSTEM FOR UNIFORMLY CHARGING A CHARGE RETENTIVE SURFACE

BACKGROUND OF THE INVENTION

This invention relates to charging a photosensitive surface, and more particularly, to contact charging a photosensitive surface without charging non-uniformities.

The process of electrostatographic copying is executed by substantially uniformly charging a photoreceptive member, exposing a light image of an original document onto the photoreceptive member in areas corresponding to non-image areas in the original document while maintaining the charge in image areas, thereby creating an electrostatic latent image of the original document on the photoreceptive member. Charged developing material is subsequently deposited onto the photoreceptive member such that the toner particles are attracted to the charged image areas on the photoreceptive member to develop the electrostatic latent image into a visible image. This developed image is then transferred from the photoreceptive member, either directly or after an intermediate transfer step, to a copy sheet or other support substrate, creating an image on the copy sheet corresponding to the original document. The transferred image may then be permanently affixed to the copy sheet through a process called fusing. In the final step, the photoconductive surface of the photoreceptive member is cleaned to remove any residual developing material thereon in preparation for successive imaging cycles.

The charging step of the above-mentioned process can be performed by a roll that is in contact with the photoconductive surface. Historically, DC charging rollers have met with the crippling difficulty of entrance nip breakdown which results in non-uniform charging and "tiger stripes" in images that are transferred to copy sheets. The phrase "tiger stripes" is used herein to mean a pattern of non-uniform charge created by cyclic breakdown events as the fields in the pre-nip region exceed the paschen breakdown limit.

PRIOR ART

Contact charging is shown in U.S. Pat. Nos. 2,912,586 and 3,398,336. In U.S. Pat. No. 2,912,586, a roll charging system is shown that includes a biased cylindrical member that comprises an inner conductive core surrounded by an outer covering layer of poor conductive material in which a pattern of insulated material is embedded. In U.S. Pat. No. 3,398,336, insulating or photoconductive insulating members are charged by passing the charge through a two-phase liquid medium which is in contact with the charging electrode and the member to be charged.

These roll charging systems and others of the type have not been completely successful in eliminating non-uniform charging and "tiger stripes" in images that are transferred to copy sheets.

SUMMARY OF THE INVENTION

Accordingly, disclosed herein is a contact charging system that includes dual rollers surrounded by a resistive belt that is in contact with a photoconductive surface to be charged. The roller at the pre-nip area is grounded while the roller at the post-nip area is kept at the desired high potential resulting in a tailored electric field such that air breakdown only occurs at the post-nip position.

BRIEF DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE INVENTION

The invention will now be described by reference to a preferred embodiment of the charging system of the present invention preferably for use in conventional copier/printers. However, it should be understood that the buffered DC contact charging method and apparatus of the present invention could be used with any machine environment in which charging of a photoreceptor is desired.

Figure 1:
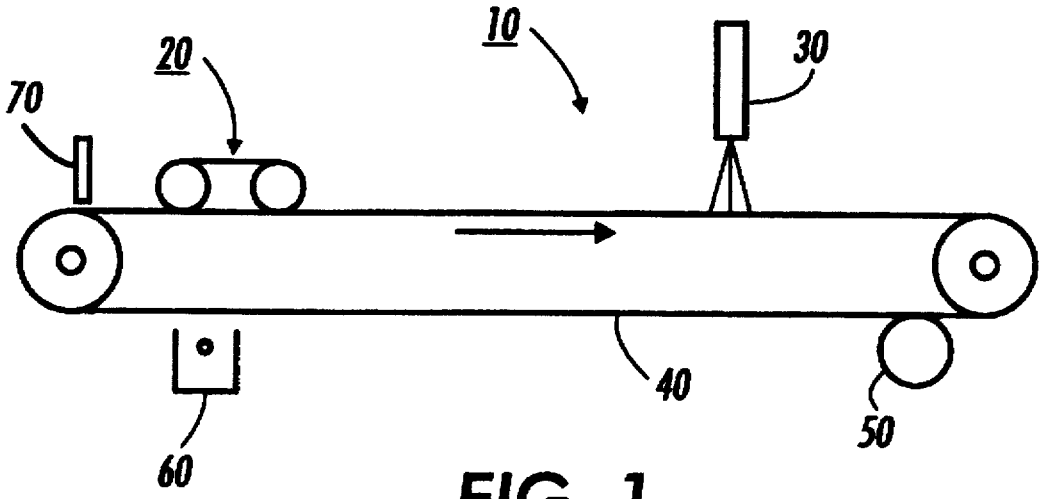
FIG. 1 is an enlarged schematic partial side view of the buffered DC contact charging apparatus of the present invention in an imaging environment.

For a general understanding of the features of the present invention, reference is made to the drawings. In the drawings like reference numerals have been used throughout to designate identical elements. FIG. 1 schematically depicts the various components of an illustrative electrostatographic printing machine incorporating the buffered DC contact charging apparatus of the present invention therein.

Describing first in further detail the exemplary copier/printer embodiment with reference to FIG. 1, there is shown a copier/printer 10 by way of example of automatic electrostatographic reproducing machines of a type like that of the existing commercial printers and copiers suitable to utilize the charging system of the present invention.

Figure 2:
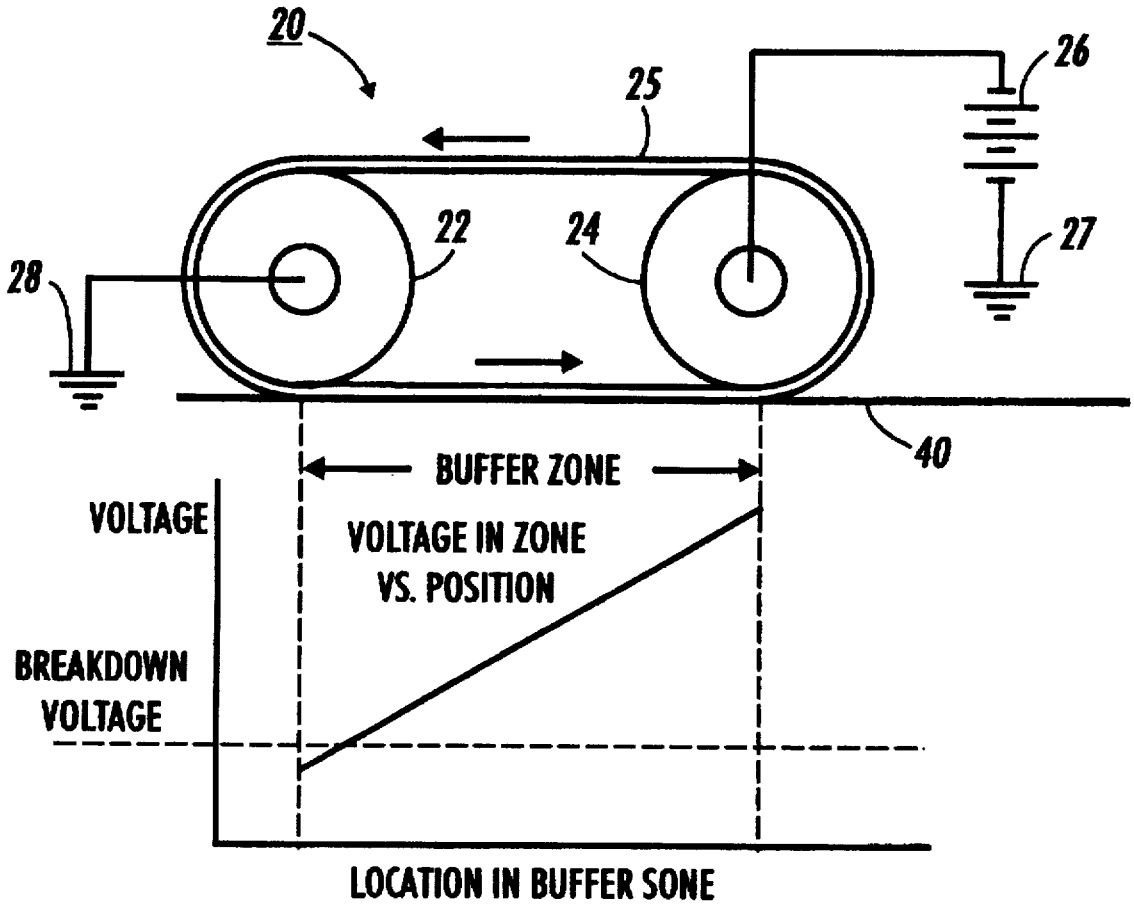
FIG. 2 is a schematic side view of a preferred embodiment of the buffered DC contact charging apparatus of FIG. 1 and a graph showing its effectiveness.

Turning now more specifically to this FIG. 1 system 10, the photoreceptor 40 rotates in the direction of arrow 12 through a number of stations in order to receive and process images of page image information. Initially, the photoreceptor is charged by the buffered DC contact charge apparatus of the present invention and the page image information is either imagewise exposed at 30 or digitally placed onto the surface of the photoreceptor. The image is developed at developing station 50 and transferred to a copy sheet at transfer station 60. Afterwards, the photoreceptor belt 40 is cleaned at cleaning station 70 and readied for imaging again. The enabler in this system that allows a high level of charge to be placed on photoreceptor 40 while simultaneously minimizing entrance nip breakdown and resultant "tiger stripe" charging non-uniformities is seen more clearly in FIG. 2, where a preferred embodiment of the buffered DC contact charging apparatus of the present invention comprises a resistive belt 25 that is entrained around a grounded roller 22 and a DC biased roller 24. The resistive belt 25 can have a resistivity of from about $10^2$ to about $10^{12}$ ohms/square dependent upon length of charge zone and a thickness of about 1 micron to about 2 mm. Roller 24 is biased at 26 and grounded at 27 while roller 22 is grounded at 28. Materials for use in belt 25 include carbon-impregnated Mylar, Teflon, polyamide films, conductive polymers and resistive elastomeric materials. The rollers 22 and 24 can be made of metal, conductive rubber or conductive soft foam. As seen in the chart underneath the belt/roller assembly 20, the field produced by biasing roller 24 is attenuated significantly at the lead roller entrance nip and is insufficient to produce premature air breakdown. The introduction of a "buffer zone" as indicated by the span of belt 25 between rollers 22 and 24 serves to reduce the voltages found in the entrance nip of the apparatus to less than breakdown levels, eliminating "tiger stripe" non-uniformities, while the high voltage present in the rear of the zone remains sufficient to ensure a high level of charge is deposited onto the photoreceptor surface. Effective voltage applied to photoreceptor 40 in the buffer zone is a function of applied voltage on biased roller 24 and resistivity of bent 25. The resistivity of belt 25 must be of sufficient magnitude to ensure that the voltage remains below breakdown levels at the entrance nip area where roller 22 presses belt 25 into contact with the photoreceptor, but conductive enough to ensure contact transfer charge at the exit nip. The climb to higher voltage levels in the latter part of the buffer zone ensures that charging will be sufficient for xerographic processing to take place. It is also possible to bias the ground or lead roller 22 to an opposite bias or bias at the level of the charge polarity desired, but not exceeding paschen air breakdown limit to lend an additional measure of control to the field applied to the photoreceptor 40 in the buffer zone.

Figure 3:
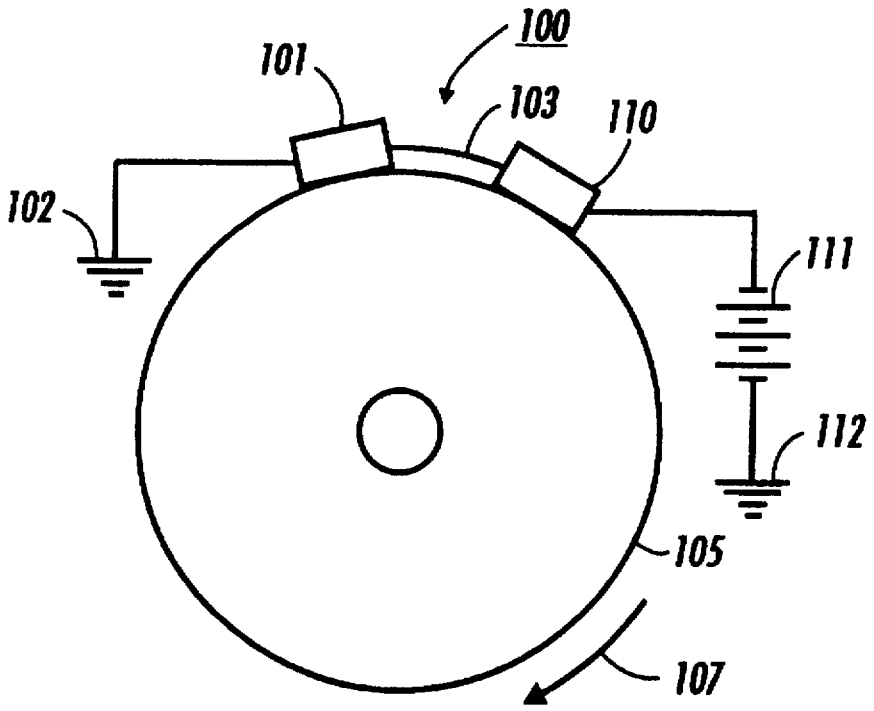
FIG. 3 is an enlarged schematic partial side view of an alternative embodiment of the buffered DC contact charging apparatus of the present invention in a printer environment.

An alternative embodiment of the buffered DC contact charging apparatus of the present invention in a low volume application is shown in FIG. 3 as 100 and comprises a conductive shoe 101 that is grounded at 102 and connected through a piece of resistive film or elastomer 103 to a conductive shoe 110 to form a resistive buffer zone between the two shoes. Resistive film 103 is a conductive material and is connected between the two shoes or positioned under each shoe while connecting the two shoes. Shoe 110 is DC biased at 111 and grounded at 112. Both shoes are positioned in sliding and charging contact with photoreceptor 105 that rotates in the direction of arrow 107 through conventional processing stations (not shown). Costs associated with the rolling mechanism of FIG. 2 can be saved with this embodiment of the present invention.

Figure 4:
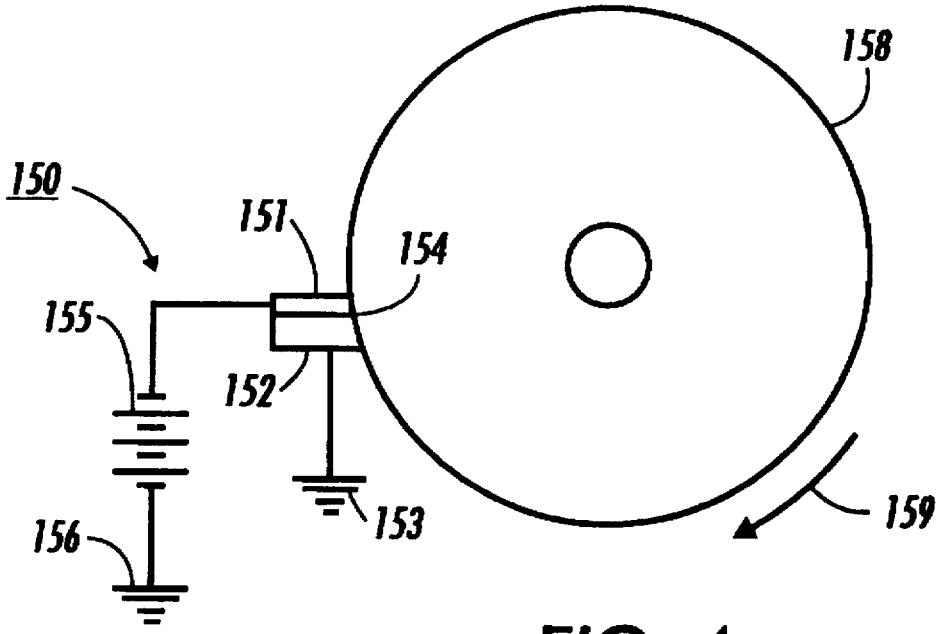
FIG. 4 is an enlarged schematic partial side view of yet another alternative embodiment of the buffered DC contact charging apparatus of the present invention in a printer environment.

In yet another embodiment of the buffered DC contact charging apparatus of the present invention in a low volume application is shown in FIG. 4 as 150 and comprises a resistive polymer sandwich charging blade that includes a portion 152 that is grounded at 153 and a portion 151 that is DC biased by source 155 which is grounded at 156. The charging blade is positioned in direct contact with photoreceptor 158 that is rotated in the direction of arrow 159. The charging unit 150 utilizes one conductive and one resistive material to produce a buffered zone with minimal complexity. Alternatively, the charging blade can comprise a single piece of material having a varying resistivity throughout or multi-layers of conductive and resistive materials.

As will be readily understood from the foregoing description, the buffered DC contact charging arrangement according to the present invention includes the benefits of roll and contact charging without the drawbacks and/or complexity of prior charging systems. Some advantages of the DC buffered charging system of the present invention include: no AC power supply being required to avoid "tiger stripes" non-uniformities; large latitude in relative humidity operation due to the long buffer zone; mechanically robust structure; and simpler manufacturing compared to conventional corona charging units.

The invention has been described in detail with particular reference to the preferred embodiment thereof, but it will be understood that reasonable variations and modifications are possible without departing from the spirit and basic scope of the invention.

We claim:

1. A printing apparatus adapted to print page image information onto copy sheets from a photoconductive surface and including a contact charging system for uniformly charging the photoconductive surface by tailoring electric fields, comprising:

a biasing source;

a pair of shoes with one of the shoes being grounded and the other being biased to a desired DC potential by said biasing source; and a resistive film in contact with said pair of shoes and wherein said film or shoes are adapted to be placed in contact with the photoconductive surface.

2. The printer apparatus of claim 1, wherein said resistive film is an elastomer.

3. The printer apparatus of claim 1, wherein said shoes are in sliding contact with said photoconductive surface.

4. A printing apparatus adapted to print page image information onto copy sheets from a photoconductive surface and including a contact charging system for uniformly charging the photoconductive surface by tailoring electric fields, comprising:

a biasing source;

a charging blade comprising dual portions with one of said dual portions being grounded and the other being biased to a desired DC potential by said biasing source, and wherein both of said dual portions have an end portion thereof in direct contact with the photoconductive surface in order to apply a charge thereto.

5. The printer apparatus of claim 4, wherein said charging blade is a resistive polymer sandwich including one conductive material and one resistive material.

6. A printing apparatus adapted to print page image information onto copy sheets from a photoconductive surface and including a contact charging system for uniformly charging the photoconductive surface by tailoring electric fields, comprising:

a biasing source;

a charging blade with one portion thereof being grounded and another portion thereof being biased to a desired DC potential by said biasing source, and wherein said charging blade has an end portion thereof in direct contact with the photoconductive surface in order to apply a charge thereto.

* * * * *